United States Patent [19]

Odai

[11] Patent Number: 5,058,458

[45] Date of Patent: Oct. 22, 1991

[54] CAMSHAFT DRIVING MECHANISM

[75] Inventor: Nobuhiro Odai, Sakato, Japan

[73] Assignee: Tsubakimoto Chain Co., Osaka, Japan

[21] Appl. No.: 514,378

[22] Filed: Apr. 27, 1990

[30] Foreign Application Priority Data

Apr. 28, 1989 [JP] Japan ..... 1-49671[U]

[51] Int. Cl.[5] ..... F01L 1/04

[52] U.S. Cl. ..... 74/665 GE; 123/90.31; 123/90.15; 74/15.63; 474/84

[58] Field of Search ..... 74/567, 15.63, 665 GE; 123/90.31, 90.15; 474/900

[56] References Cited

U.S. PATENT DOCUMENTS 2,479,617 8/1949 Hawley et al. ..... 123/90.31 X
4,750,455 6/1988 Ebesu ..... 123/90.31
4,878,461 11/1989 Sapienza, IV et al. ..... 123/90.15

FOREIGN PATENT DOCUMENTS 62-32203 2/1987 Japan ..... 123/90.31

*Primary Examiner*—Allan D. Herrmann
*Assistant Examiner*—Julie Krolikowski
*Attorney, Agent, or Firm*—Howson & Howson

[57] ABSTRACT

A camshaft driving mechanism in an internal combustion engine is disclosed. It comprises a crank sprocket, a cam sprocket and an idler sprocket disposed therebetween, a first timing chain entrained on the crank sprocket and idler sprocket, and a second timing chain entrained on said idler sprocket and cam sprocket. The improvement resides in that the first timing chain is sized smaller than the second timing chain.

9 Claims, 2 Drawing Sheets

CAMSHAFT DRIVING MECHANISM

FIELD OF THE INVENTION

The present invention relates to a camshaft driving mechanism for transmitting a torque from a crankshaft to a camshaft in an internal combustion engine.

BACKGROUND OF THE INVENTION

Conventionally, there is a camshaft driving mechanism comprising a crank sprocket, a cam sprocket and an idler sprocket disposed therebetween. A first timing chain spans the crank sprocket and the idler sprocket while a second chain spans the idler sprocket and the cam sprocket.

The number of revolution of the camshaft must be one half of that of the crankshaft. Therefore, a speed reduction is effected between the second timing chain and the first timing chain in the above-mentioned camshaft driving mechanism. Thus, the second timing chain is used at a speed slower than that of the first timing chain, but its load capacity is higher.

However, in the conventional driving mechanism, chains of the same type (size) are used for both the first and second timing chains. This means that the first chain is excessive in terms of the load capacity.

On the other hand, since the first timing chain runs at a speed greater than that of the second timing chain, being large-sized itself can be a cause of noises. Moreover, the two timing chains being of the same size the driving mechanism is susceptible to resonance. In addition, a larger mounting space is required adjacent to an engine itself.

SUMMARY OF THE INVENTION

The present invention provides a camshaft driving mechanism comprising a crank sprocket, a cam sprocket and an idler sprocket disposed therebetween, a first timing chain entrained on said crank sprocket and idler sprocket, and a second timing chain entrained on said idler sprocket and cam sprocket, characterized in that said first timing chain is sized smaller than the second timing chain.

The small-sized first timing chain may be obtained in various ways. For example, it may be achieved by reduction in the pitch of the chain, reduction in the width of the link plates of the chain, reduction in the thickness of the link plates of the chain, or reduction in the diameters of the pins, bushings and rollers, etc.

As result of the above-mentioned reduction in the size of the first timing chain, the first timing chain may be made compact, lightweight, thereby reducing noises even at a high speed operation. Also, it contributes to the reduction of the mounting space of the camshaft driving mechanism.

Particularly by making the pitch of the first timing chain smaller than that of the second timing chain, the probability of occurrence of resonance may be suppressed.

DESCRIPTION OF THE PREFERRED EMBODIMENT

Figure 1:
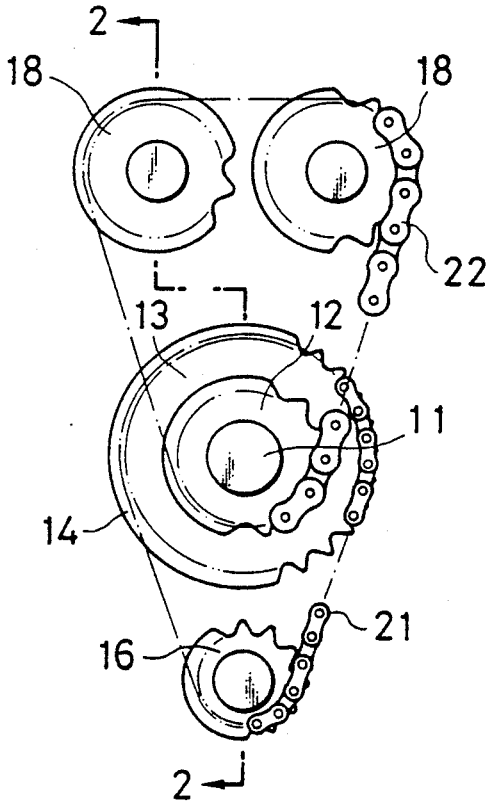
FIG. 1 is a front view of the camshaft driving mechanism according to the present invention
Figure 2:
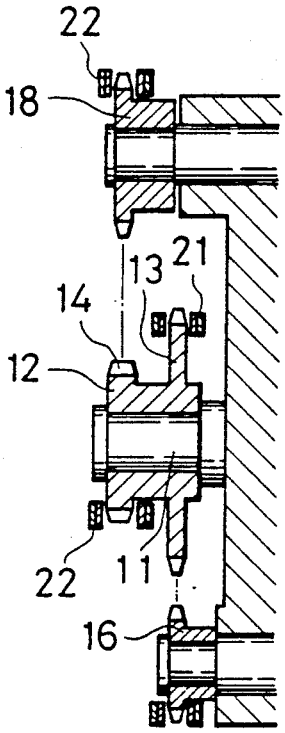
FIG. 2 is a section at line 2—2 of FIG. 1.

With reference to FIGS. 1 and 2, there are shown an engine block 10, an intermediate shaft 11 and an idler sprocket 12 mounted to said shaft 11. The idler sprocket 12 includes a first toothed portion 18 in the same plane as the crank sprocket 16 and a second toothed portion 14 in the same plane as the cam sprockets 18. 18. The number of the teeth of the first toothed portion 13 is twice as large as that of the crank sprocket 16 and the second toothed portion 14 has the same number of teeth as the cam sprockets 18, 18. The first timing chain 21 spans the crank sprocket 16 and the idler sprocket 12; and the second timing chain 22 spans the idler sprocket 12 and the cam sprockets 18, 18.

In the illustrated embodiment, the pitch of the first timing chain 21 is 8.000 mm; and that of the second timing chain 22 is 9.526 mm. Namely, the pitch of the first timing chain 21 is smaller than that of the second timing chain 22.

Figure 3:
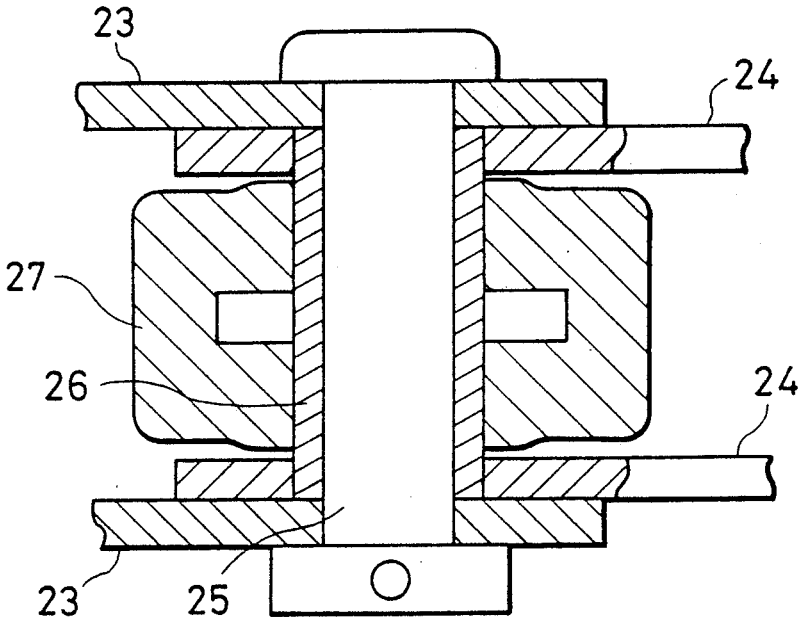
FIG. 3 PRIOR ART
FIG. 3 is a sectional view showing the link structure of a typical conventional roller-type timing chain.

The conventional timing chain, as shown in FIG. 3 comprises outer link plates 23, inner link plates 24, a transverse pin 25, a bushing 26 surrounding the pin, and a sprocket-engaging roller 27.

Although not shown in the drawings, the first timing chain 21 is sized smaller than the second timing chain 22 in other respects. Namely, the width of the link plates, thickness of the link plates, diameters of the pins, bushings and the rollers of the first timing chain 21 are all smaller than those of the second timing chain 22.

What is claimed is:

1. In a camshaft driving mechanism comprising a crank sprocket, a cam sprocket and idler means disposed therebetween, said idler means comprising first and second idler sprockets fixed on a common shaft, a first timing chain entrained on said crank sprocket and said first idler sprocket, and a second timing chain entrained on said second idler sprocket and said cam sprocket, in which each timing chain comprises elements in the categories of link plates extending lengthwise of the chain and transverse pins connecting the link plates, an improvement characterized in that the link plates and pins of said first timing chain are all of a size equal to or smaller than the size of the corresponding elements of the second timing chain, and the elements of said first timing chain, in at least one of said categories, are smaller than the elements, in said same category, of said second timing chain.

2. The camshaft driving mechanism according to claim 1 wherein the pitch of the first timing chain is smaller than that of the second timing chain.

3. The camshaft driving mechanism according to claim 2 in which the diameter of said first idler sprocket is greater than that of said crank sprocket, whereby the first idler sprocket rotates at a speed slower than that of the crank sprocket.

4. The camshaft driving mechanism according to claim 2 in which the diameter of said first idler sprocket is greater than that of said second sprocket.

5. The camshaft driving mechanism according to claim 1 in which the diameter of said first idler sprocket is greater than that of said crank sprocket, whereby the first idler sprocket rotates at a speed slower than that of the crank sprocket.

6. The camshaft driving mechanism according to claim 1 in which the diameter of said first diameter sprocket is greater than that of said second sprocket.

7. The camshaft driving mechanism according to claim 1 in which the width and thickness of the link plates of the first timing chain, are respectively smaller than the width and thickness of the link plates of the second timing chain, and in which the diameters of the pins of the first timing chain are respectively smaller than the diameters of the pins of the second timing chain.

8. The camshaft driving mechanism of claim 1 in which said categories include bushings and rollers, and in which said bushings and rollers are mounted coaxially on said pins, and in which the bushings and rollers of said first timing chain are all of a size equal to or smaller than the size of the bushings and rollers, respectively, of the second timing chain.

9. The camshaft driving mechanism according to claim 8 in which the width and thickness of the link plates of the first timing chain, are respectively smaller than the width and thickness of the link plates of the second timing chain, and in which the diameters of the pins, bushings and rollers of the first timing chain are respectively smaller than the diameters of the pins, bushings and rollers of the second timing chain.

* * * * *

UNITED STATES PATENT AND TRADEMARK OFFICE

CERTIFICATE OF CORRECTION

PATENT NO. : 5,058,458

DATED : October 22, 1991

INVENTOR(S) : Nobuhiro Odai

It is certified that error appears in the above-identified patent and that said Letters Patent is hereby corrected as shown below:

Column 2, line 7, "18" should read --13--;
Column 2, line 19, "9.526" should read --9.525--;

Column 2, line 67, the second occurrence of "diameter" should read --idler--.

Signed and Sealed this

Thirtieth Day of March, 1993

*Attest:*

STEPHEN G. KUNIN

*Attesting Officer*

*Acting Commissioner of Patents and Trademarks*